US007841664B2

(12) United States Patent
Holdredge et al.

(10) Patent No.: US 7,841,664 B2
(45) Date of Patent: Nov. 30, 2010

(54) CHAIR WITH CONTROL SYSTEM

(75) Inventors: Russell Holdredge, Alto, MI (US); Christopher Norman, Byron Center, MI (US); Kurt Heidmann, Grand Rapids, MI (US); Brian H. Root, Grandville, MI (US); Mark Dinnewith, Spring Lake, MI (US)

(73) Assignee: Steelcase Inc., Grand Rapids, MI (US)

( * ) Notice: Subject to any disclaimer, the term of this patent is extended or adjusted under 35 U.S.C. 154(b) by 85 days.

(21) Appl. No.: 12/133,339

(22) Filed: Jun. 4, 2008

(65) Prior Publication Data

US 2009/0302649 A1 Dec. 10, 2009

(51) Int. Cl.
*A47C 1/024* (2006.01)

(52) U.S. Cl. ..... 297/300.2; 297/303.1; 297/300.1

(58) Field of Classification Search ..... 297/300.1, 297/300.2, 300.4, 312, 316, 285, 302.1, 301.1, 297/301.3, 303.1
See application file for complete search history.

(56) References Cited

U.S. PATENT DOCUMENTS

| | | | |
|---|---|---|---|
| 56,718 | A | 7/1866 | Coomes |
| 119,732 | A | 10/1871 | Aldrich et al. |
| 346,311 | A | 7/1886 | Parry |
| 485,273 | A | 11/1892 | Hacklaender |
| 538,708 | A | 5/1895 | Smith |
| 2,512,353 | A | 6/1950 | Magaldino et al. |
| 2,530,924 | A | 11/1950 | Turner |
| D164,204 | S | 8/1951 | Smith |
| 2,798,538 | A | 7/1957 | Dreifke |
| 2,799,323 | A | 7/1957 | Berg |
| 2,817,388 | A | 12/1957 | Knabusch et al. |
| 2,843,195 | A | 7/1958 | Barvaeus |
| 2,893,476 | A | 7/1959 | Liljengren |
| 3,036,864 | A | 5/1962 | Arai |

(Continued)

FOREIGN PATENT DOCUMENTS

FR 2549704 A1 2/1985

(Continued)

OTHER PUBLICATIONS

PCT International Search Report Issued in connection with PCT Application No. PCT/US2009/002780.

*Primary Examiner*—David Dunn
*Assistant Examiner*—Erika Garrett
(74) *Attorney, Agent, or Firm*—McDermott Will & Emery LLP

(57) ABSTRACT

According to the present invention, a control system for a chair is provided. The control system is comprised of first and second resilient blocks, first and second stabilizing members and first and second rockers. The first stabilizing member has first and second ends and defines a first horizontal axis. The first end of the first stabilizing member extends into the first resilient block and the second end of the first stabilizing member extends into the second resilient block. The second stabilizing member is coupled to the first stabilizing member by a connector. The second stabilizing member has first and second ends and defines a second horizontal axis disposed in parallel to the first horizontal axis. The first end of the second stabilizing member is operably coupled to the first rocker, and the second end of the second stabilizing member is operably coupled to the second rocker.

27 Claims, 14 Drawing Sheets

U.S. PATENT DOCUMENTS

| | | | | |
|---|---|---|---|---|
| D194,740 | S | 3/1963 | Parker | |
| 3,080,195 | A | 3/1963 | Berg | |
| 3,203,734 | A | 8/1965 | Home | |
| 3,255,470 | A | 6/1966 | Knittel et al. | |
| 3,263,247 | A | 8/1966 | Knittel et al. | |
| 3,276,048 | A | 10/1966 | Beckman | |
| 3,280,410 | A | 10/1966 | Propst et al. | |
| 3,339,972 | A | 9/1967 | Fletcher | |
| 3,402,964 | A | 9/1968 | Williams | |
| 3,592,433 | A | 7/1971 | Fuhrman | |
| 3,598,354 | A | 8/1971 | Williams | |
| 3,612,604 | A | 10/1971 | Meinhardt | |
| 3,669,499 | A | 6/1972 | Semplonius et al. | |
| 3,672,723 | A | 6/1972 | Decursu et al. | |
| 3,697,132 | A | 10/1972 | Van Surksum | |
| 3,740,014 | A | 6/1973 | Swenson et al. | |
| 3,813,073 | A | 5/1974 | Mohr et al. | |
| 3,868,144 | A | 2/1975 | Lie | |
| 4,062,590 | A | 12/1977 | Polsky et al. | |
| 4,194,255 | A | 3/1980 | Poppe | |
| 4,295,626 | A | 10/1981 | Large | |
| 4,372,609 | A | 2/1983 | Boisset | |
| 4,383,714 | A | 5/1983 | Ishida | |
| 4,386,805 | A | 6/1983 | Boisset | |
| 4,410,214 | A | 10/1983 | Geschwender | |
| 4,429,427 | A | 2/1984 | Sklar | |
| 4,534,592 | A | 8/1985 | Hattori | |
| 4,575,151 | A | 3/1986 | Edstrom | |
| 4,580,836 | A | 4/1986 | Verney | |
| 4,744,603 | A | 5/1988 | Knoblock | |
| 4,776,633 | A | 10/1988 | Knoblock et al. | |
| 4,919,485 | A | 4/1990 | Guichon | |
| 4,925,244 | A | 5/1990 | Nava | |
| 4,928,334 | A | 5/1990 | Kita | |
| 4,971,394 | A | 11/1990 | Vanderminden | |
| 5,015,034 | A | 5/1991 | Kindig et al. | |
| D319,354 | S | 8/1991 | Wolcott | |
| 5,040,847 | A | 8/1991 | Nguyen | |
| 5,102,196 | A | 4/1992 | Kaneda et al. | |
| 5,121,963 | A | 6/1992 | Kwasnik et al. | |
| D330,292 | S | 10/1992 | Nguyen | |
| D332,530 | S | 1/1993 | Nguyen | |
| D341,265 | S | 11/1993 | Gehry | |
| D343,317 | S | 1/1994 | Poo | |
| D344,191 | S | 2/1994 | Gehry | |
| D344,202 | S | 2/1994 | Schwartz | |
| D345,656 | S | 4/1994 | Theobald | |
| 5,333,934 | A | 8/1994 | Knoblock | |
| 5,338,091 | A | 8/1994 | Miller | |
| 5,352,022 | A | 10/1994 | Knoblock | |
| 5,366,273 | A | 11/1994 | Bresch | |
| D360,538 | S | 7/1995 | Skalka | |
| 5,435,621 | A | 7/1995 | Komorowski et al. | |
| 5,487,591 | A | 1/1996 | Knoblock | |
| 5,498,065 | A | 3/1996 | Tosoni | |
| 5,564,781 | A | 10/1996 | Pine | |
| 5,577,803 | A | 11/1996 | Guilbaud | |
| 5,577,811 | A | 11/1996 | Ogg | |
| 5,588,704 | A | 12/1996 | Harza | |
| 5,611,598 | A | 3/1997 | Knoblock | |
| 5,662,383 | A | 9/1997 | Hand | |
| 5,664,835 | A | 9/1997 | Desanta | |
| 5,683,142 | A | 11/1997 | Gunderson et al. | |
| 5,735,575 | A | 4/1998 | Harza | |
| 5,762,399 | A | 6/1998 | Liu | |
| 5,762,403 | A | 6/1998 | Robnson | |
| 5,769,492 | A | 6/1998 | Jensen | |
| 5,826,944 | A | 10/1998 | Beneker et al. | |
| 5,857,750 | A | 1/1999 | Kashiwamura et al. | |
| 5,938,284 | A | 8/1999 | Coffield | |
| D413,452 | S | 9/1999 | Rhienen | |
| D420,824 | S | 2/2000 | Lin | |
| 6,019,428 | A | 2/2000 | Coffield | |
| 6,027,171 | A | 2/2000 | Partington et al. | |
| 6,042,093 | A | 3/2000 | Garelick | |
| 6,059,368 | A | 5/2000 | Stumpf et al. | |
| 6,079,782 | A | 6/2000 | Berg et al. | |
| 6,102,477 | A | 8/2000 | Kurtz | |
| 6,186,594 | B1 | 2/2001 | Valiquette et al. | |
| 6,231,125 | B1 | 5/2001 | Maeda et al. | |
| 6,273,506 | B1 | 8/2001 | Niergarth et al. | |
| 6,309,015 | B1 | 10/2001 | Pine | |
| 6,367,876 | B2 | 4/2002 | Caruso et al. | |
| 6,378,942 | B1 | 4/2002 | Chu | |
| 6,378,944 | B1 | 4/2002 | Weisser | |
| 6,382,723 | B1 | 5/2002 | Piretti | |
| 6,382,724 | B1 | 5/2002 | Piretti | |
| 6,386,634 | B1 | 5/2002 | Stumpf et al. | |
| 6,386,638 | B1 | 5/2002 | Strauch | |
| 6,419,318 | B1 | 7/2002 | Albright | |
| 6,425,633 | B1 | 7/2002 | Wilkerson et al. | |
| 6,439,665 | B1 | 8/2002 | Cvek | |
| 6,511,562 | B1 | 1/2003 | Coffield | |
| 6,523,898 | B1 | 2/2003 | Ball et al. | |
| 6,540,950 | B1 | 4/2003 | Coffield | |
| 6,550,866 | B1 | 4/2003 | Su | |
| 6,582,019 | B2 | 6/2003 | Insalaco et al. | |
| 6,619,749 | B2 | 9/2003 | Willy | |
| 6,626,494 | B2 | 9/2003 | Yoo | |
| 6,644,741 | B2 * | 11/2003 | Nelson et al. | 297/302.1 |
| 6,669,292 | B2 | 12/2003 | Koepke et al. | |
| 6,688,687 | B2 | 2/2004 | Chu | |
| 6,688,688 | B2 | 2/2004 | Uhlenbrock | |
| 6,688,690 | B2 | 2/2004 | Watson et al. | |
| 6,698,833 | B2 | 3/2004 | Ball et al. | |
| 6,702,382 | B1 | 3/2004 | Hoover et al. | |
| 6,712,427 | B1 | 3/2004 | Bourdkane et al. | |
| 6,725,523 | B2 | 4/2004 | Chiang | |
| 6,726,286 | B2 | 4/2004 | Stumpf et al. | |
| 6,739,671 | B2 | 5/2004 | De Maina | |
| 6,752,458 | B1 | 6/2004 | Rivera | |
| 6,752,464 | B1 | 6/2004 | Tseng | |
| 6,755,467 | B1 | 6/2004 | Chu | |
| 6,758,528 | B2 | 7/2004 | Kawashima | |
| 6,839,950 | B2 | 1/2005 | Guillot | |
| 6,842,959 | B2 | 1/2005 | Coffield et al. | |
| 6,866,340 | B1 | 3/2005 | Robertshaw | |
| 6,899,398 | B2 | 5/2005 | Coffield | |
| D506,629 | S | 6/2005 | Koepke et al. | |
| 6,913,315 | B2 | 7/2005 | Ball et al. | |
| D509,975 | S | 9/2005 | Pan | |
| 6,942,295 | B1 * | 9/2005 | Lopez | 297/300.1 |
| 6,942,300 | B2 | 9/2005 | Numa et al. | |
| 6,945,599 | B2 | 9/2005 | May | |
| D510,671 | S | 10/2005 | Wu | |
| 6,955,402 | B2 | 10/2005 | VanDeRiet et al. | |
| 6,957,862 | B2 * | 10/2005 | Chen | 297/300.1 |
| 6,966,606 | B2 | 11/2005 | Coffield | |
| 6,969,115 | B2 | 11/2005 | Bourdkane et al. | |
| 6,971,717 | B1 | 12/2005 | Rhodes | |
| 6,983,997 | B2 | 1/2006 | Wilkerson et al. | |
| 6,991,285 | B1 | 1/2006 | Hemenway | |
| 7,004,543 | B2 * | 2/2006 | Caruso et al. | 297/300.2 |
| 7,021,711 | B1 | 4/2006 | Hoffman et al. | |
| 7,032,971 | B2 | 4/2006 | Williams | |
| 7,052,088 | B2 | 5/2006 | Aramburu | |
| 7,096,549 | B2 | 8/2006 | Coffield | |
| 7,097,247 | B2 | 8/2006 | Battey et al. | |
| 7,128,373 | B2 | 10/2006 | Kurtycz et al. | |
| 7,131,694 | B1 | 11/2006 | Buffa | |
| 7,159,293 | B2 | 1/2007 | Coffield et al. | |
| 7,175,232 | B2 | 2/2007 | Rivera | |
| 7,216,933 | B2 | 5/2007 | Schmidt et al. | |
| 7,234,772 | B2 | 6/2007 | Wells | |

| | | | | |
|---|---|---|---|---|
| 7,243,993 | B2 * | 7/2007 | Igarashi et al. | 297/300.4 |
| 7,252,339 | B2 | 8/2007 | Owens | |
| 7,270,378 | B2 | 9/2007 | Wilkerson et al. | |
| 7,293,833 | B2 | 11/2007 | Takeuchi et al. | |
| 7,331,633 | B2 | 2/2008 | Balensiefer et al. | |
| 7,350,865 | B2 * | 4/2008 | Pearse | 297/312 |
| 7,425,037 | B2 * | 9/2008 | Schmitz et al. | 297/300.2 |
| 2002/0003371 | A1 | 1/2002 | Link | |
| 2002/0195863 | A1 | 12/2002 | Su | |
| 2003/0197407 | A1 * | 10/2003 | Sanchez | 297/353 |
| 2004/0262975 | A1 | 12/2004 | Su | |
| 2005/0093354 | A1 | 5/2005 | Ball et al. | |
| 2006/0006715 | A1 | 1/2006 | Chadwick et al. | |
| 2006/0091715 | A1 * | 5/2006 | Schmitz et al. | 297/411.36 |
| 2007/0035169 | A1 | 2/2007 | Sawyer | |
| 2007/0057548 | A1 | 3/2007 | Buffa | |
| 2007/0057549 | A1 | 3/2007 | Ball et al. | |
| 2007/0228799 | A1 | 10/2007 | Kinoshita et al. | |
| 2009/0021065 | A1 * | 1/2009 | Brauning | 297/344.19 |

FOREIGN PATENT DOCUMENTS

| | | | |
|---|---|---|---|
| FR | 2676630 | A | 11/1992 |
| WO | WO 2006014577 | A | 2/2006 |
| WO | WO 2006/094258 | A2 | 9/2006 |
| WO | WO 2007124609 | A | 11/2007 |

* cited by examiner

FIG. 16
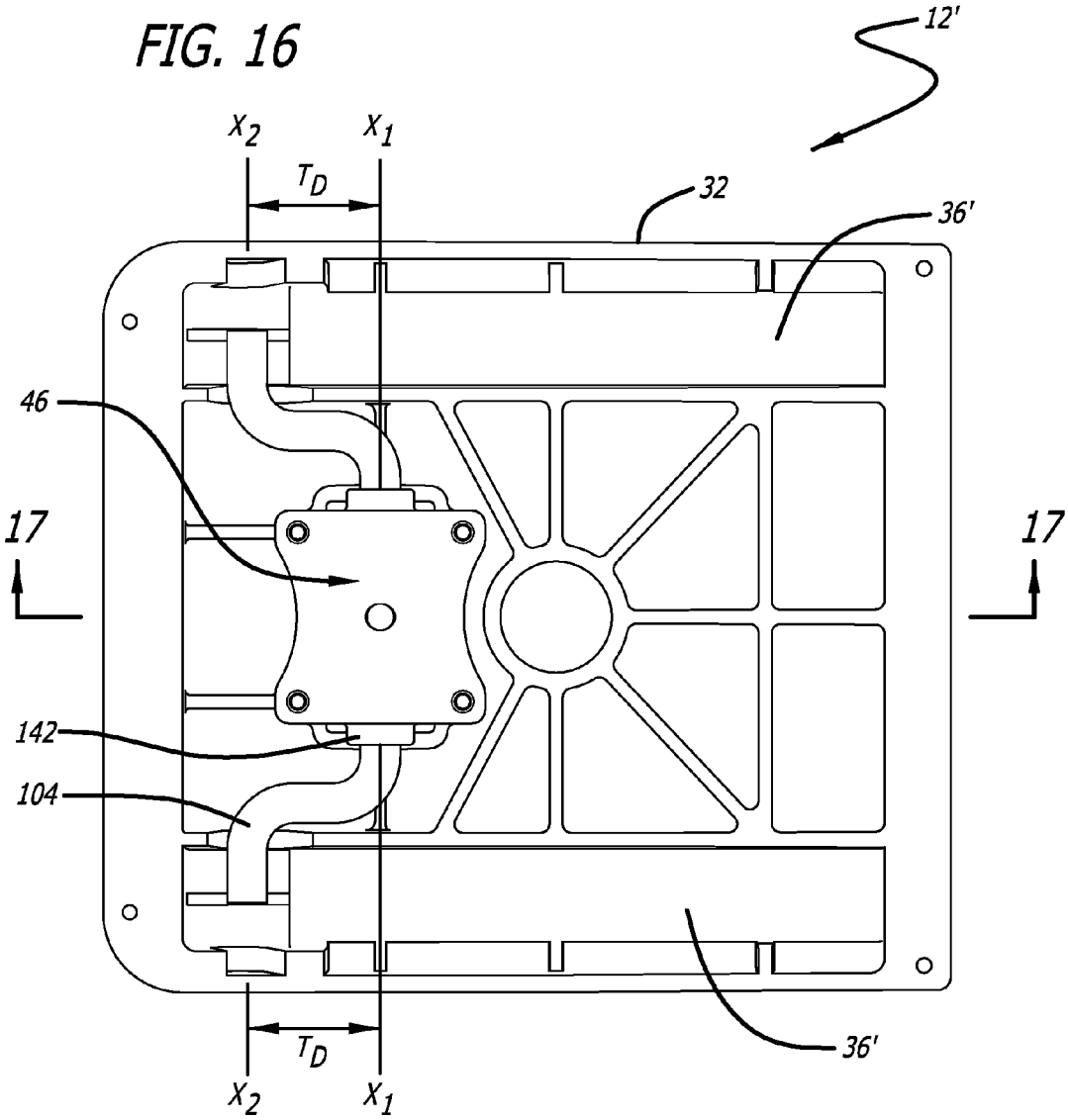
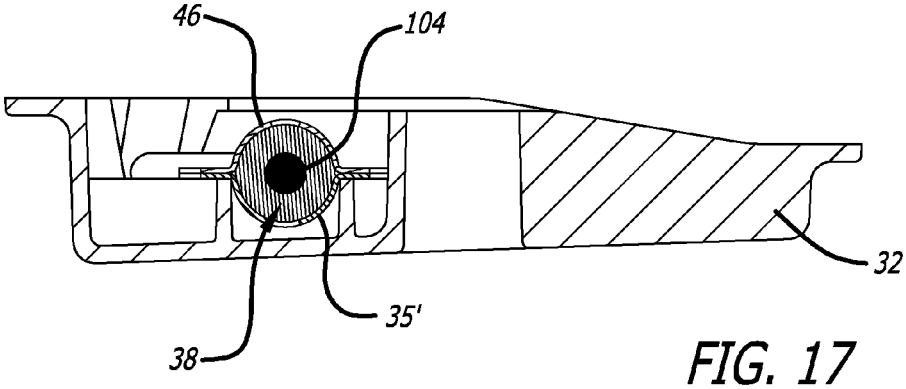
FIG. 17

CHAIR WITH CONTROL SYSTEM

TECHNICAL FIELD

The present invention relates to a chair, and more particularly, to a chair with an underseat control system.

BACKGROUND OF THE INVENTION

Modern chairs often include backs and seats that are capable of several functional motions about multiple planes of motion. In particular, many chairs include underseat motion control mechanisms to provide independent sliding, pivoting and rocker motions that allow components to move in a particular way relative to the seated user so as to provide an optimally comfortable and adjustable chair motion. However, these control mechanisms tend to be complex control mechanisms that require several independent external actuators to perform the motional functions. Furthermore, such control mechanisms tend not to act in simultaneous response to varying movements and postures of a seated user. Instead, the control mechanisms often require independent actuator activation, and they tend to respond independently of one another. Further, the independently actuated mechanisms take up space and can become structurally large in size. This is less desirable for chairs requiring a simple profile or otherwise requiring a clean unobstructed area under their seat. Also, design of these mechanisms is a complex task, with substantial time required to understand and work out competing functional requirements and physical relationships between motion mechanisms.

Accordingly, it is desirable to provide a seat with a motion control mechanism having the aforementioned advantages and solving the aforementioned problems. More particularly, it is desirable to provide a seat control that facilitates synchronous rocking and reclining motion in response to user movement. It is also desirable to provide a seat control that provides appropriate mechanisms to prevent over-motion of the chair. In particular, it is desirable to provide suitable controls for resisting or damping excessive roll, yaw, fore-aft and side-to-side translation of the chair relative to ground. It is also desirable to provide a control mechanism that employs few or no external actuators. It is also desirable to provide a relatively small, compact control mechanism.

The present invention is provided to solve the problems discussed above and other problems, and to provide advantages and aspects not previously provided. A full discussion of the features and advantages of the present invention is deferred to the following detailed description, which proceeds with reference to the accompanying drawings.

SUMMARY OF THE INVENTION

According to the present invention, a control system for a chair is provided. The control system is comprised of first and second resilient blocks, first and second stabilizing members and first and second rockers. The first stabilizing member has first and second ends and defines a first horizontal axis. The first end of the first stabilizing member extends into the first resilient block and the second end of the first stabilizing member extends into the second resilient block. The second stabilizing member is coupled to the first stabilizing member by a connector. The second stabilizing member has first and second ends and defines a second horizontal axis disposed in parallel to the first horizontal axis. The first and second ends of the second stabilizing member are adapted to be operably coupled to a seat component of a chair, and preferably coupled to the seat component and back fame of a chair. In particular, the first end of the second stabilizing member is operably coupled to the first rocker, and the second end of the second stabilizing member is operably coupled to the second rocker.

According to another aspect of the present invention, the control system includes a coupling assembly for coupling the first and second ends of the second stabilizing member to the respective first and second rocker. The coupling assembly is comprised of a slot formed in each of the first and second rockers. The coupling assembly also includes a slider bearing at each of the first and second ends of the second stabilizing member. The first and second ends of the stabilizing member rotatably engage the slider bearing, and the slider bearing slidably engages the slot corresponding to one of the first and second rockers. The slider bearing can have a male mating portion which engages a corresponding female portion in the slot. Thus, the coupling assembly permits translation of each of the first and second rockers relative to the second stabilizing member in a direction generally perpendicular to the motion of the second horizontal axis during recline and permits rotation around the second horizontal axis.

According to another aspect of the present invention, a control system for a chair is provided. The control system includes at least one resilient block, a stabilizing member and first and second rockers. The resilient block has an inner core, at least a portion of which is formed from a resiliently compressible material. The stabilizing member has a first end, an opposed second end and a middle portion. The first and second ends of the stabilizing member define a first horizontal axis. The middle portion of the stabilizing member extends through the inner core of the resilient block and defines a second horizontal axis. The second horizontal axis is disposed parallel to, and at a distance from, the first horizontal axis. The first rocker is coupled to the first end of the stabilizing member and the second rocker is coupled to the second end of the stabilizing member.

According to yet another aspect of the present invention, a seating unit for supporting a seated user is provided. The seating unit includes a base, a back component, a seat component and an underseat control system. The underseat control system is operably coupled to the seat component and is disposed in a seat control housing. The seat control housing has interior bottom surface, and preferably housing walls.

The underseat control system is comprised of first and second resilient blocks, first and second stabilizing members and first and second rockers. The first resilient block and second resilient block each have an inner core in which at least a portion of their respective inner cores is formed from a resiliently compressible material. The first stabilizing member has first and second opposed ends and defines a first horizontal axis. The first end of the first stabilizing member extends into the inner core of the first resilient block and the opposed second end of the first stabilizing member extends into the inner core of the second resilient block.

The second stabilizing member is coupled to the first stabilizing member by a connector. The second stabilizing member has first and second opposed ends and defines a second horizontal axis disposed in parallel to the first stabilizing member. The first rocker is attached to the first end of the second stabilizing member. The first rocker is also operably coupled to the seat component of the chair, and preferably coupled to the seat component and the chair back. The first rocker has a forward end and a rearward end and a rocker contact surface that engages at least a portion of the interior surface of the seat control housing. Similarly, the second rocker is attached to the second end of the second stabilizing member and is also operably coupled to the seat component of a chair. The second rocker also has a forward end and a rearward end and a rocker contact surface that engages at least a portion of the interior surface of the seat control housing.

Other features and advantages of the invention will be apparent to those of skill in the art from the following specification and claims, taken in conjunction with the appended drawings.

BRIEF DESCRIPTION OF THE DRAWINGS

To understand the present invention, it will now be described by way of example, with reference to the accompanying drawings in which:

FIG. 16 is a top view of the control system shown in FIG. 15; and,

FIG. 17 is a side cross-sectional view of the control system shown in FIG. 15, taken through line 17-17.

Figure 1:
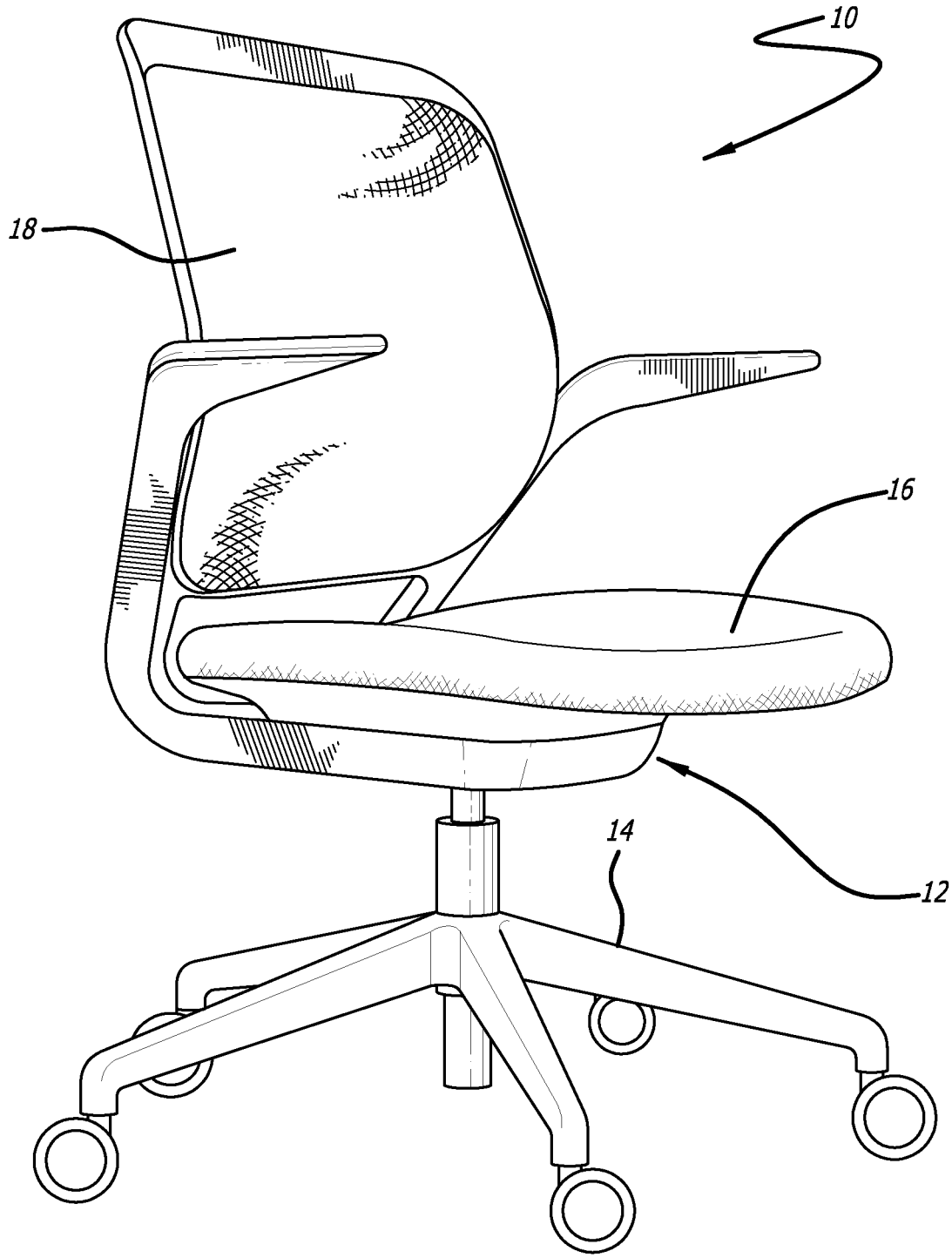
FIG. 1 is a front perspective view of a chair employing the control system of the present invention.
Figure 2:
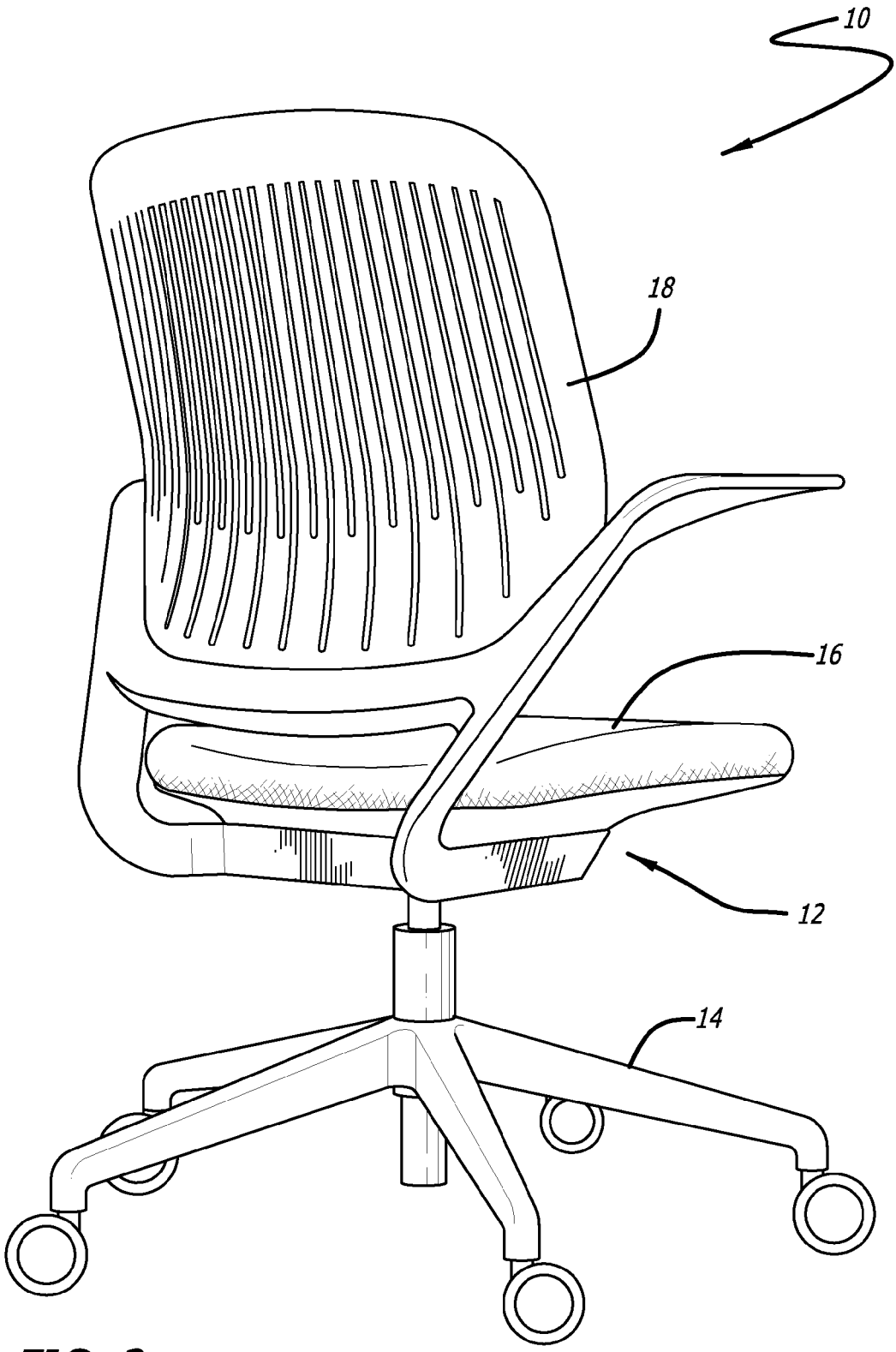
FIG. 2 is a rear perspective view of the chair of FIG. 1.
Figure 3:
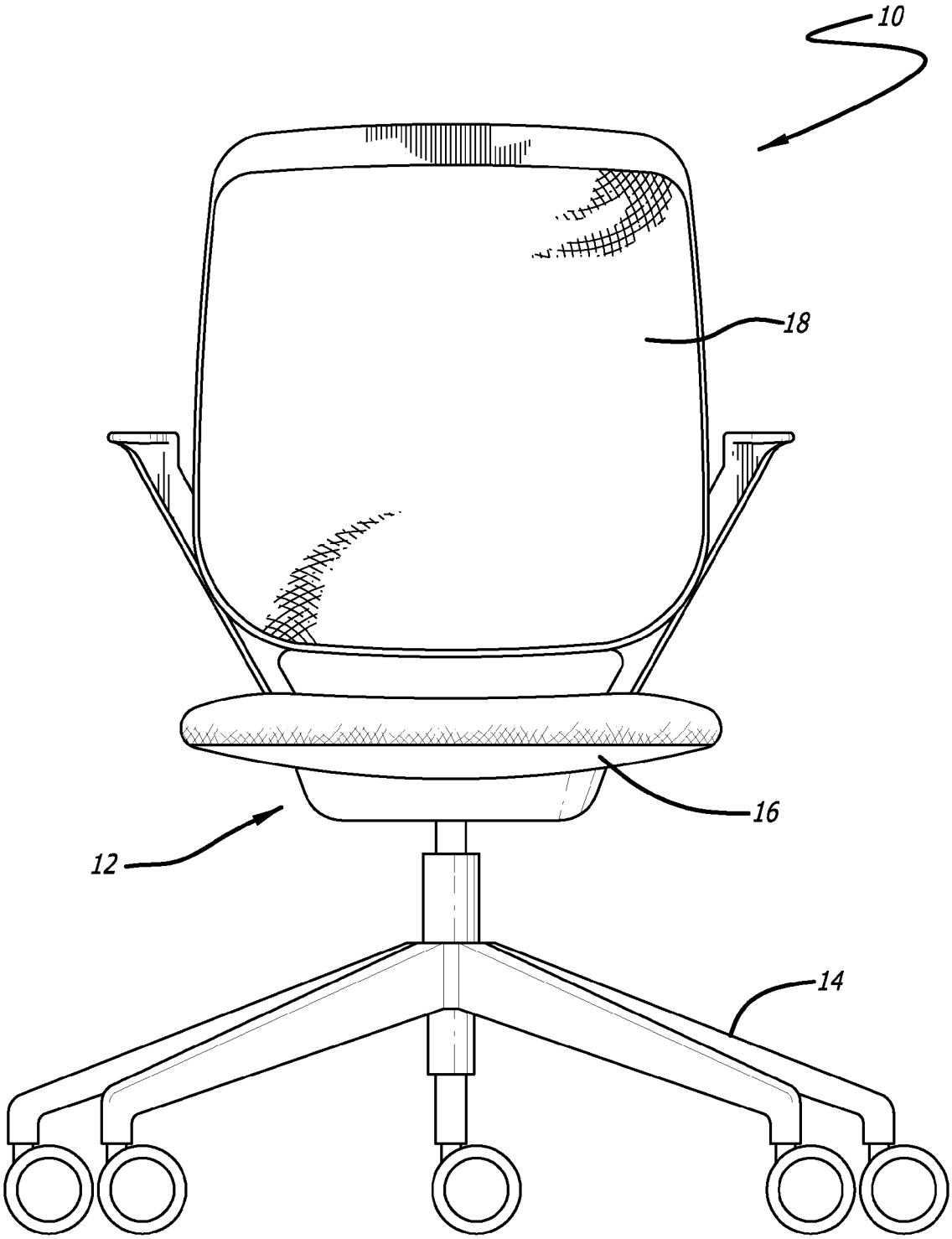
FIG. 3 is a front elevation view of the chair of FIG. 1.
Figure 4:
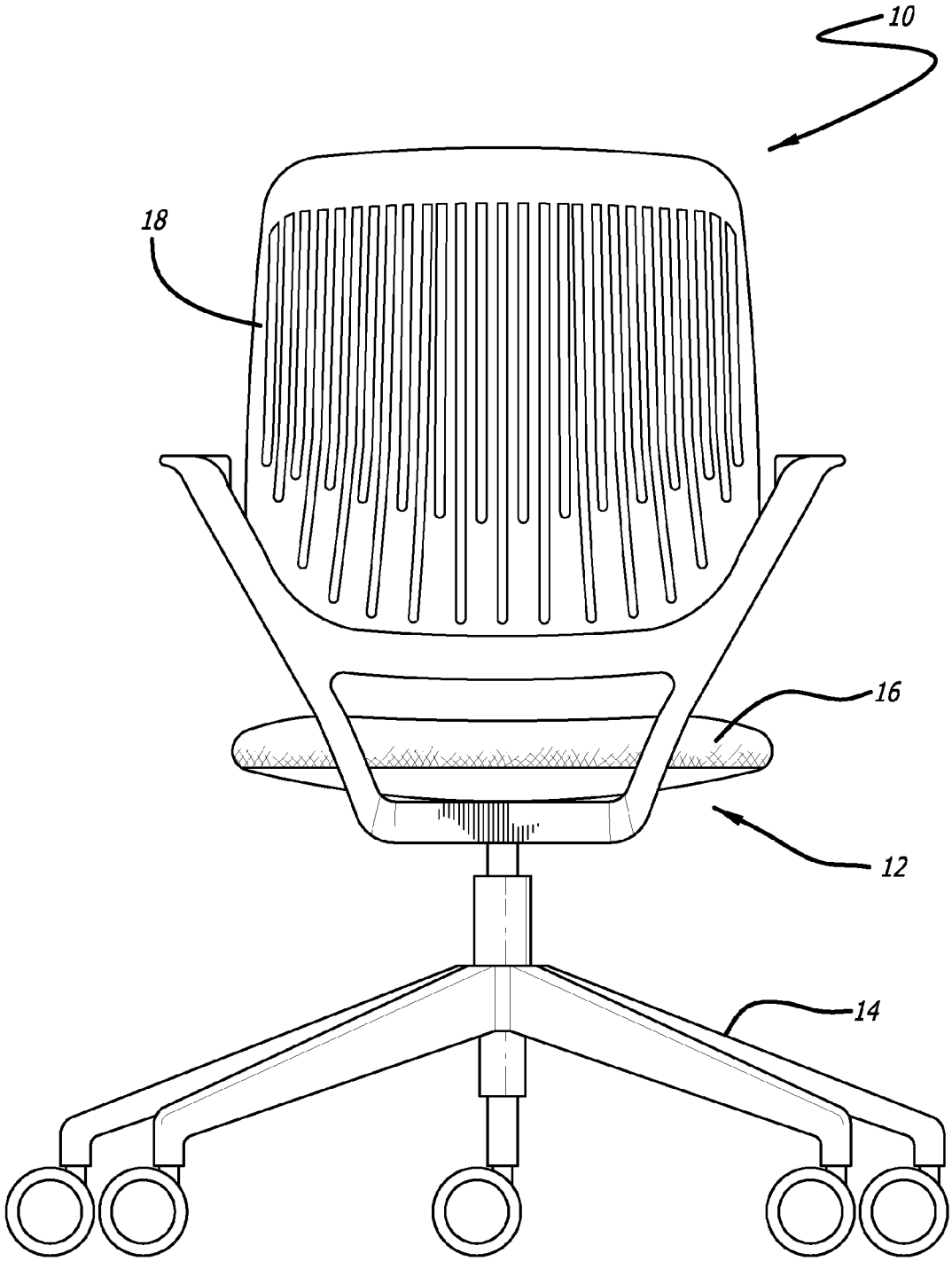
FIG. 4 is a rear elevation view of the chair of FIG. 1.
Figure 5:
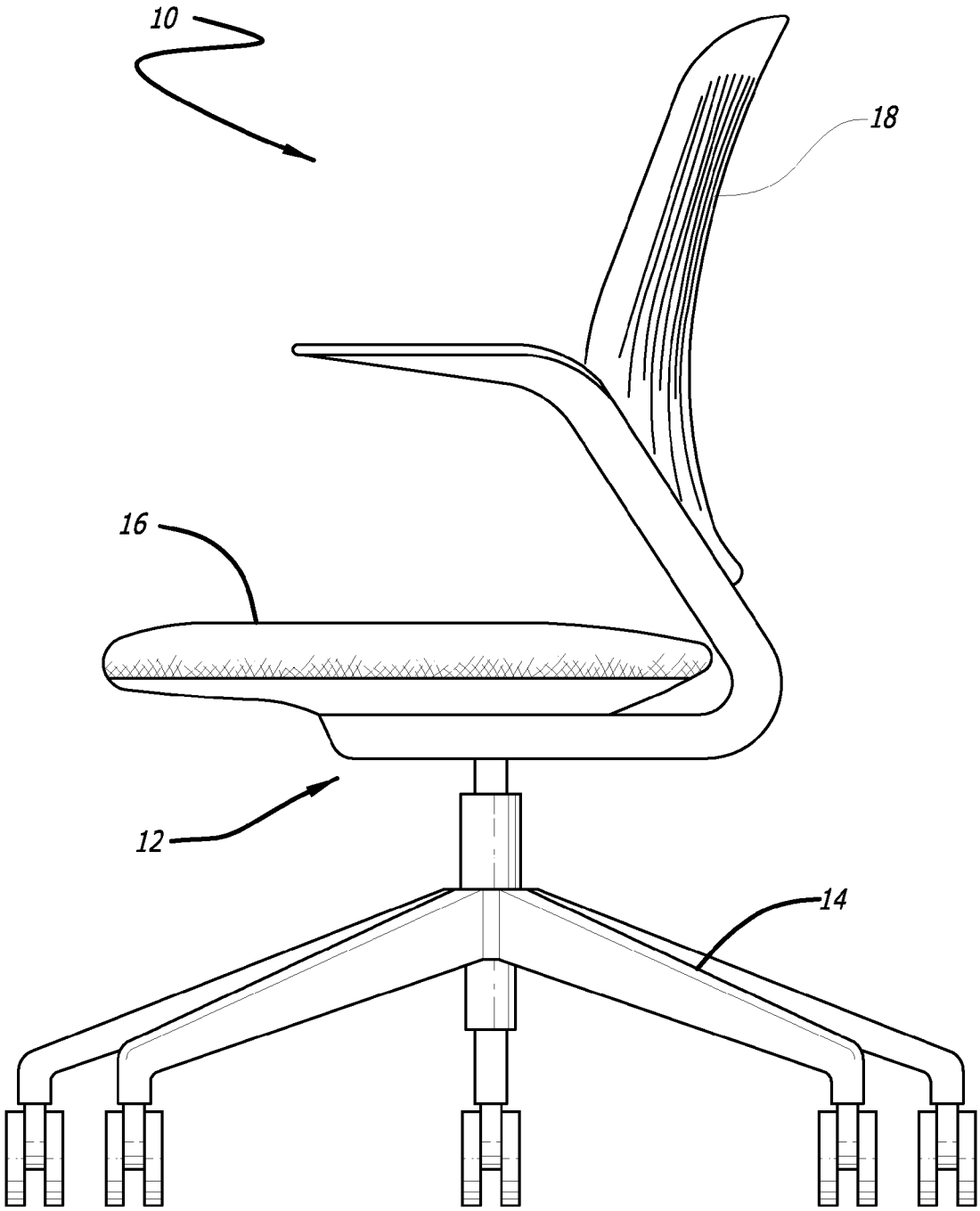
FIG. 5 is side a view of the chair of FIG. 1.

The components in the drawings are not necessarily to scale, emphasis instead being placed upon clearly illustrating the principles of the present invention.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

As shown in FIGS. 1-5, a chair 10 incorporating an underseat control system 12 of the present invention typically includes a base 14, a seat component 16 comprised of a seat plate and a seat shell, and a back 18. The seat component 16 and the back 18 are typically operably supported on the base 14 by the underseat control system 12.

The underseat control system 12 of the present invention is configured to permit synchronous rocking and reclining motion of the seat component 16 and back 18. However, the underseat control system 12 also provides appropriate mechanisms to prevent uncontrolled motion or over-motion of the seat component 16 and back 18. In particular, the underseat control system 12 is configured to resist or dampen excessive roll (i.e., sided to side tipping) and yaw of the seat component 16 and back 18. The underseat control system 12 is also configured to restrain excessive fore-aft and side-to-side translation of the seat component 16 and back 18 relative to ground or the remainder of the chair 10. The underseat control system 12 of the present invention also assists in biasing the seat component 16 and back 18 to an upright position. In other words, the underseat control system 12 of the present invention manages the movement of a seat component 16 and back 18 of a chair 10 that accommodates various degrees of motion in reaction to changes in the posture of a sitting user or of various users.

Figure 6:
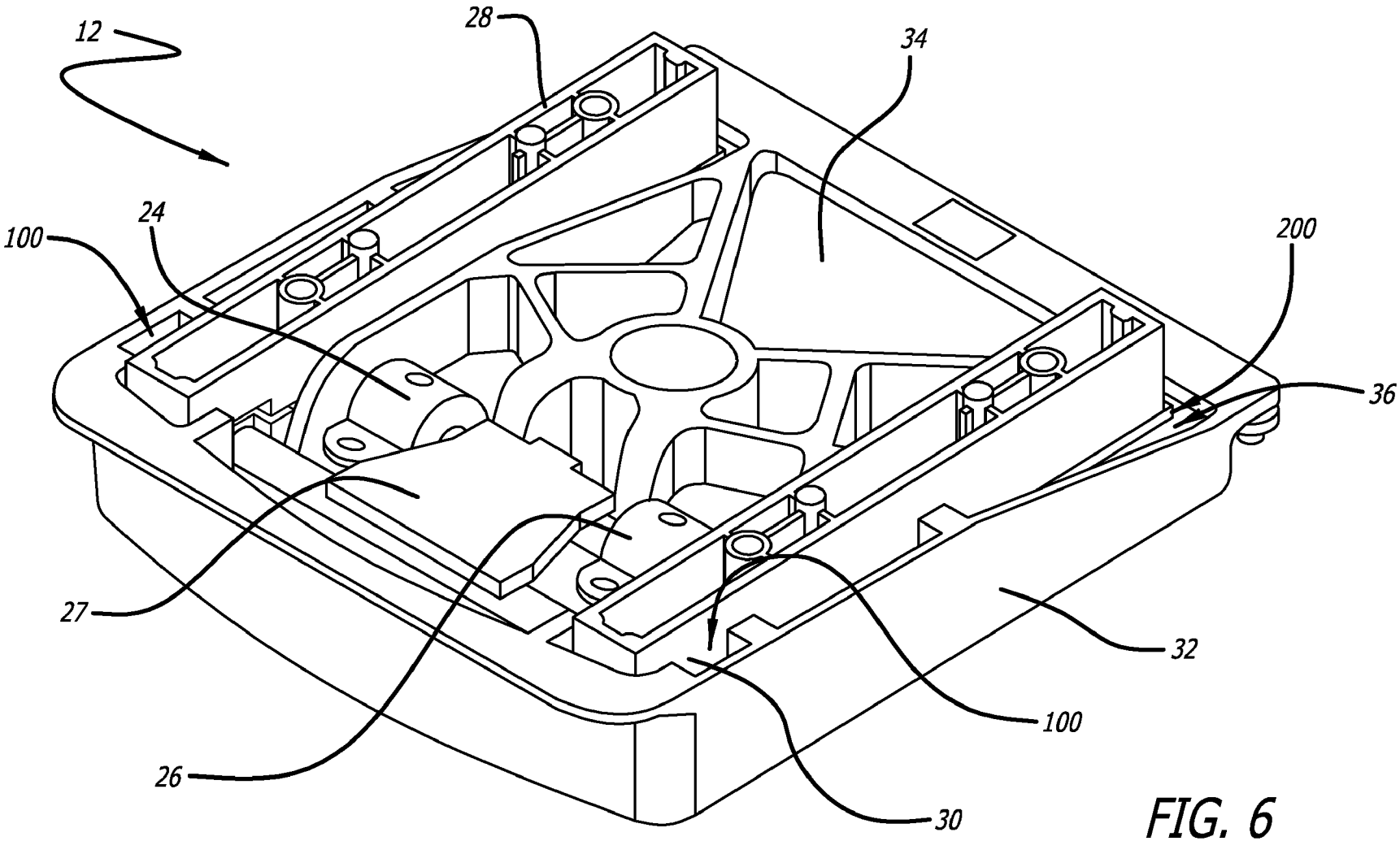
FIG. 6 is a perspective view of a control system according to the present invention, with control housing.
Figure 7A:
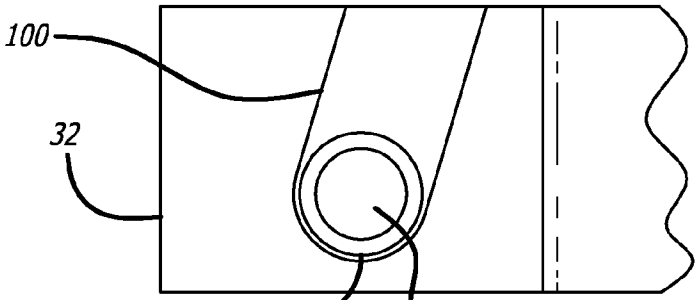
FIG. 7A is a schematic view of the post, roller and slot engagement between a rocker and the inner wall of the control housing according to one embodiment of the present invention.
Figure 7:
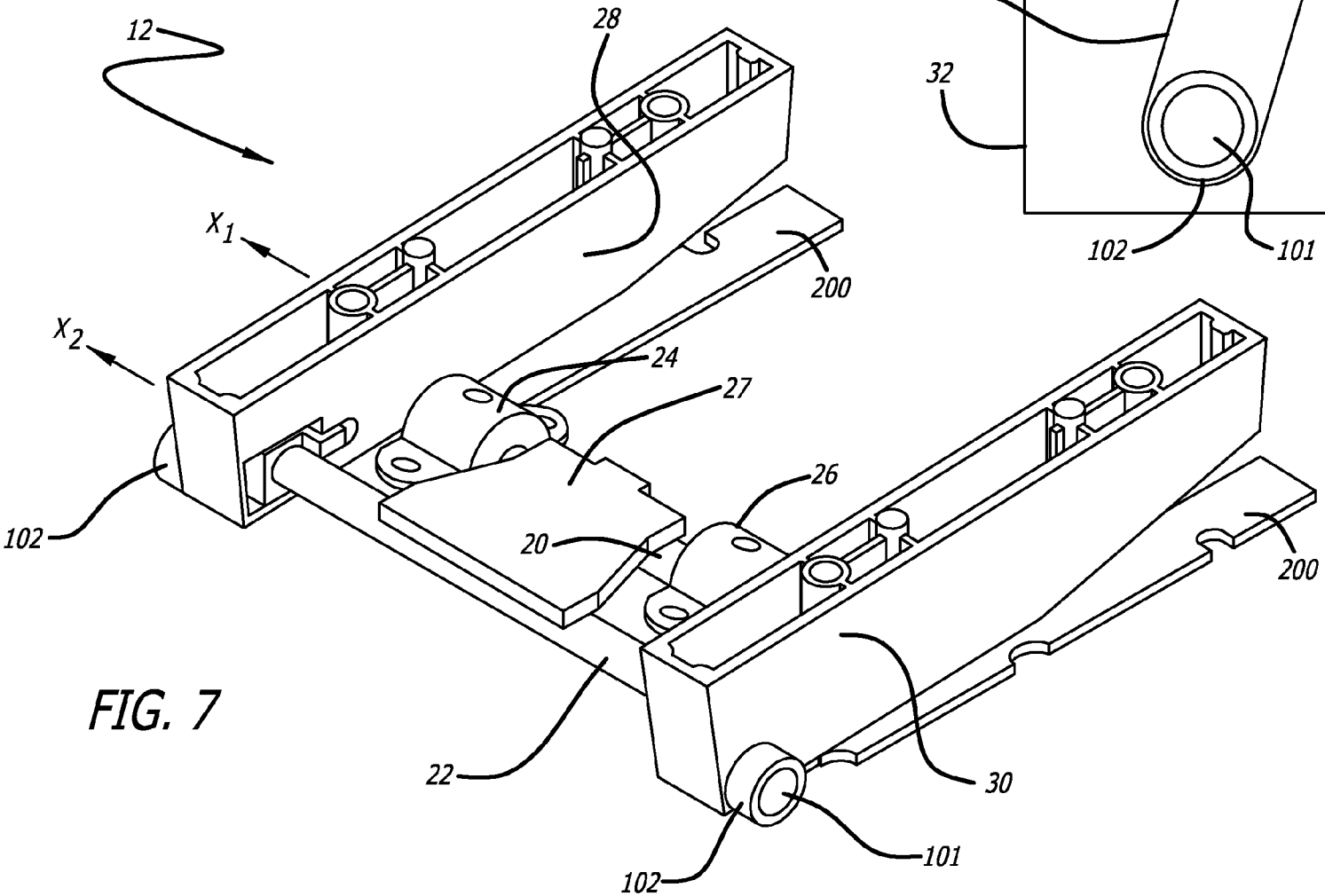
FIG. 7 is a perspective view of a control system according to the present invention, illustrated without control housing.
Figure 8:
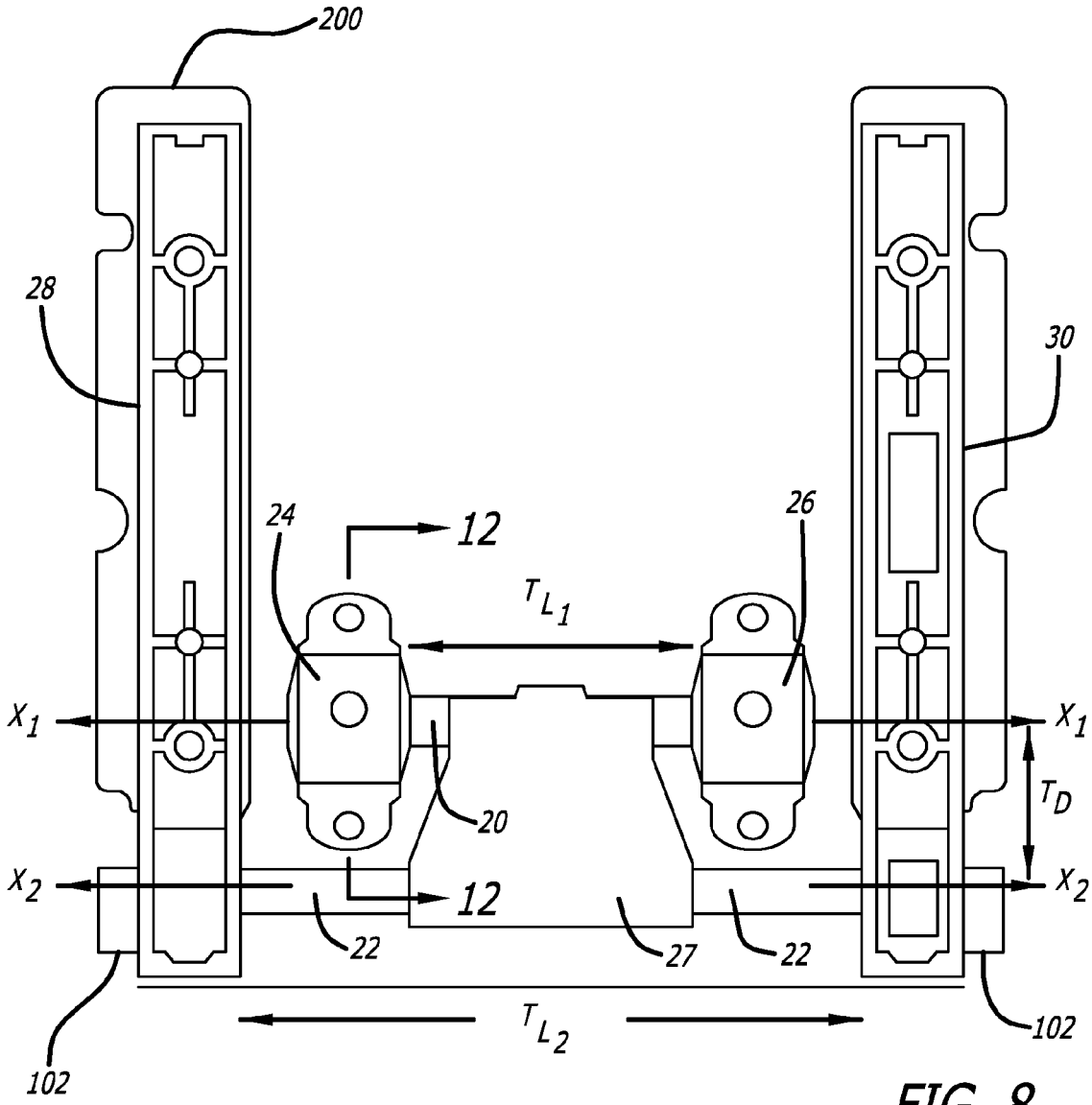
FIG. 8 is a top view of the control system shown in FIG.7.
Figure 9:
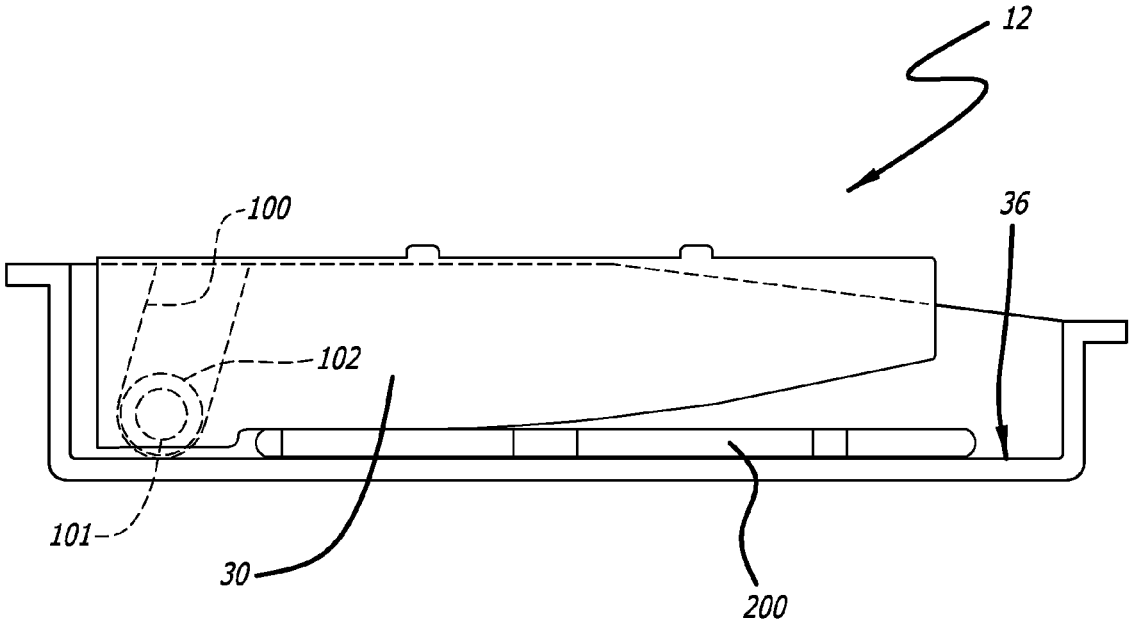
FIG. 9 is a schematic view of the control system shown in FIG. 6.
Figure 10:
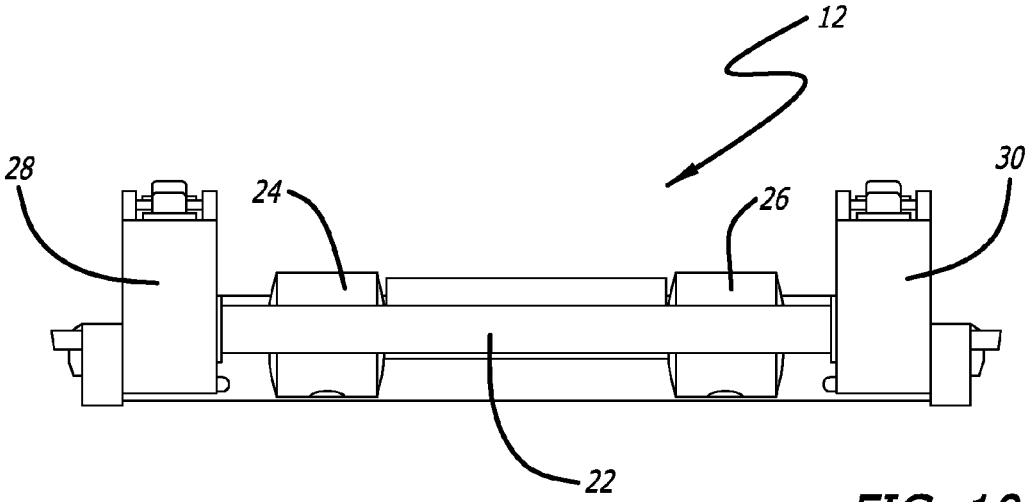
FIG. 10 is a rear view of the control system shown in FIG. 7.

Referring now to FIGS. 6-9, the underseat control system 12 of the present invention is comprised of first and second stabilizing members 20, 22, first and second resilient blocks 24, 26 and first and second rockers 28, 30. According to a preferred embodiment of the present invention, the control system 12 is disposed within a control housing 32. As shown in FIGS. 6-8, the interior bottom surface 34 of the control housing 32 includes at least one rocking surface 36. The first and second rockers 28, 30 are positioned within the control housing 32 to engage the at least one rocking surface 36.

The rocking surface 36 can also include a damping material 200 disposed on at least a portion of the rocking surface 36. The damping material 200 may be any material that helps to retard non-harmonious engagement of the rocker members with the rocking surface 36 and thus assists in reducing noise and interference resulting from the engagement of the rocker members thereon. For example, and without limitation, the damping material 200 can be a natural rubber, a synthetic rubber or any other known suitable damping material 200. Thus it is contemplated that the rocker contact surface of the first and second rockers 28, 30 can engage the dampening material. Alternatively, the rocker contact surface of the first and second rockers 28, 30 can directly engage the bottom surface 34 of the control housing 32 when no dampening material is employed.

According to one preferred embodiment of the present invention, the rocking surface 36 is a horizontal surface relative to the generally vertical seat shaft upon which the chair seat component is attached. Thus, when the control system 12 is installed in a chair 10, the rocking surface 36 is generally parallel to the surface on which a chair 10 sits. However, it will be understood that the rocking surface 36 may also be canted or inclined without departing from the present invention. It will also be understood to those of skill in the art that the rocking surface 36 may be a single surface or a plurality of surfaces defined in a bottom surface 34 of the control housing 32. For example, in one preferred embodiment of the invention shown in FIGS. 6-8, the housing 32 includes a first and a second rocking surfaces 36 that each provide a rocker contact surface for a respective one of the first and second rockers 28, 30. However, it is also contemplated that the control housing 32 could include a single rocking surface 36 defined by the bottom surface 34 of the control housing 32.

According to one embodiment of the present invention shown in FIGS. 6-8 and 12, the first stabilizing member 20 has first and second opposed ends. The first stabilizing member 20 defines a first horizontal axis ($x_1$) within the control system housing 32. The first end of the first stabilizing member 20 extends into the inner core 38 of the first resilient block 24 and the opposed second end of the first stabilizing member 20 extends into the inner core 38 of the second resilient block 26. The first stabilizing member 20 and resilient blocks 24, 26 act cooperatively with the second stabilizing member 22 and its attachment to the rockers 28, 30 (as discussed below), to retard vertical translation and side-to-side roll of the seat component 16 of the chair 10. More particularly, the inner core 38 of each of the resilient blocks 24, 26 is compressed by the first stabilizing member 20 as a result of vertical translation and side-to-side roll of the seat component 16 relative to ground, and thus, absorb the energy transferred through the stabilizing members 20, 22 to the inner core 38 of the resilient blocks 24, 26. During recline the resilient blocks 24, 26 store energy through torsional deflection of the resilient material (e.g., the inner core 38) which assists in righting the chair 10.

The second stabilizing member 22 also has first and second opposed ends. As shown in FIG. 7, the second stabilizing member 22 defines a second horizontal axis ($x_2$) disposed in parallel to the first stabilizing member 20. The first end of the second stabilizing member 22 is operably coupled to the first rocker 28, and the second end of the second stabilizing member 22 is operably coupled to the second rocker 30.

Figure 13:
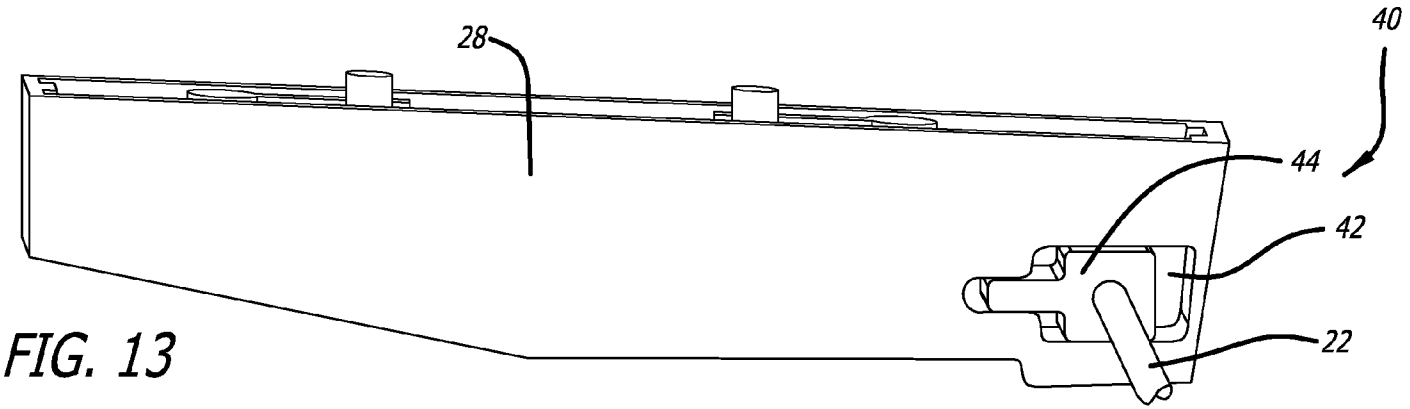
FIG. 13 is a perspective view of a coupling assembly used in connection with the control system of the present invention.
Figure 14:
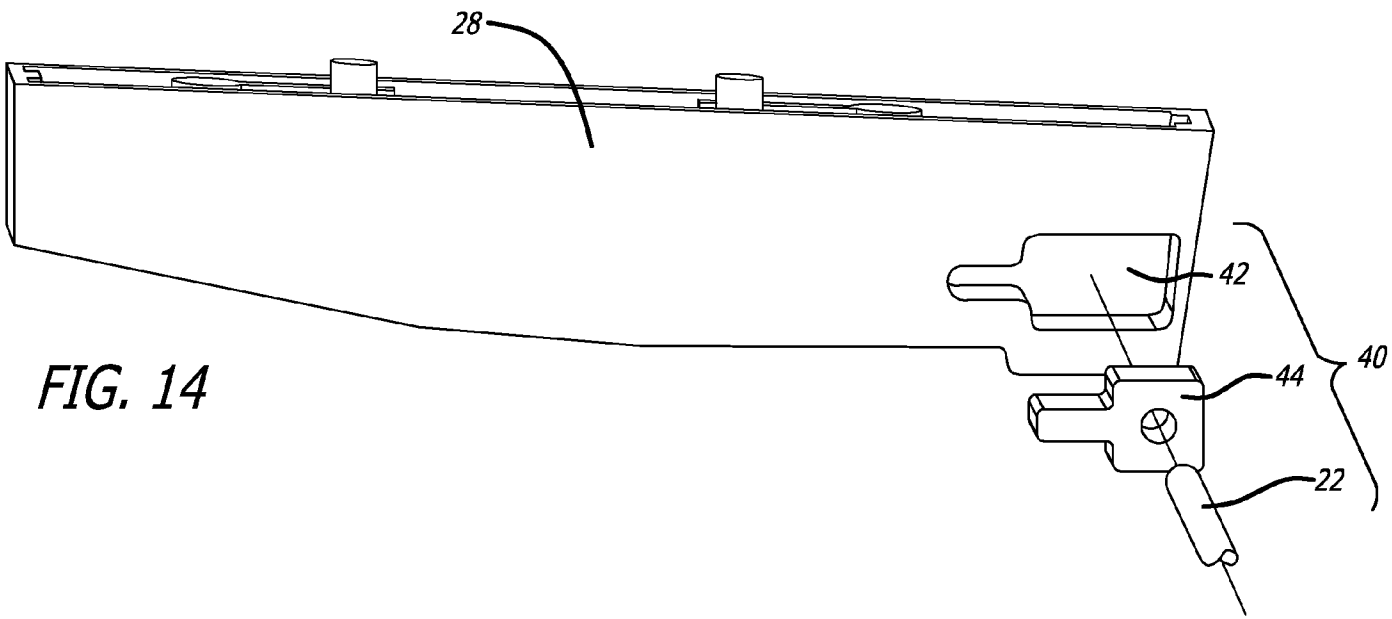
FIG. 14 is an exploded perspective view of a coupling assembly shown in FIG. 13.

In one embodiment of the invention, the control system 12 includes a coupling assembly 40 for coupling the first and second ends of the second stabilizing member 22 to the respective first and second rockers 28, 30. As shown in FIGS. 13 and 14, the coupling assembly 40 is comprised of a slot 42 formed in each of the first and second rockers 28, 30, and a slider bearing 44 coupled to each of the first and second ends of the second stabilizing member 22. According to the present invention, each of the first and second ends of second stabilizing member 22 rotatably engages a respective slider bearing 44, and each of the slider bearings 44 slidably engage a respective slot 42 in the corresponding one of the first and second rockers 28, 30. This configuration permits motion of each of the first and second rockers 28, 30 relative to the second stabilizing member 22. In one embodiment of the invention, the slider bearing 44 includes a male member adapted to mate with a female engaging edge of the slot 42.

In one embodiment of the invention shown in FIGS. 6, 7 and 7A, the first and second rockers 28, 30 each include a post 101 and a roller 102 that operably engage a slot 100 in the inner wall of the control housing 32. The post 101, roller 102, and slot 100 cooperatively act to provide a resistive force to loads applied as a result of fore-aft translation, as well as side-to-side translation, of the seat component 16 relative to the remaining chair 10 components. The configuration of the post 101, roller 102 and slot 100 acting with the second stabilizing member 22 also assist in retarding the yaw of the seat component 16. Preferably, the back 18 moves with the seat component 16.

The first and second stabilizing members 20, 22 are preferably steel bars having a first end. According to the embodiment shown in FIGS. 6 and 7, the first and second stabilizing members 20, 22 each have a generally circular cross-section. However, it will be understood that the first and second stabilizing members 20, 22 may each have other geometric cross-sections without departing from the present invention. For example, and without limitation, the cross-sectional geometry of either or both of the first and second stabilizing members 20, 22 can be rectangular, octagonal, elliptical or any other geometric cross-section. It will also be understood by those of skill in the art that the stabilizing members can assume configurations other than that of a bar. For example, and without limitation, either or both of the stabilizing members can be an elongated strip. Additionally, while preferably formed from steel, the first and second members can be formed from any material capable of resilient deformation when loaded, but of sufficient rigidity to transfer a load to adjacent components as described herein.

As shown in FIG. 8, the second stabilizing member 22 preferably has a length $T_{L2}$ that is greater length than the length $T_{L1}$ of the first stabilizing member 20. More particularly, the second stabilizing member 22 has a length $T_{L2}$ that, in combination with the first and second rockers 28, 30, substantially traverses the width of the control housing 32. The length $T_{L1}$ of the first stabilizing member 20 is sized such that the first stabilizing member 20, in combination with the first and second resilient blocks 24, 26, can be disposed between the opposed first and second rockers 28, 30.

As previously discussed, the first end of the second stabilizing member 22 is coupled to the first rocker 28. The second end of the second stabilizing member 22 is coupled to the second rocker 30. The first and second rockers 28, 30 are in turn coupled to the seat component 16 of the chair 10. Thus, the first and second ends of the second stabilizing member 22 are effectively adapted to receive a load applied to the seat component 16 of the chair 10. The portion of the second stabilizing member 22 between the first and second ends facilitates the transfer of the side-to-side rolling, recline and rocking load received by the first and second ends of the second stabilizing member 22 to the first stabilizing member 20.

Likewise the first stabilizing member 20 includes a portion that is adapted to receive a load from the second stabilizing member 22. The first and second ends of the first stabilizing member 20 are respectively coupled to the first and second resilient blocks 24, 26. Thus, the first and second ends of the first stabilizing member 20 transfer side-to-side rolling, recline and rocking load received by the first stabilizing member 20 to "ground."

As shown in FIG. 8, the first stabilizing member 20 and second stabilizing member 22 are coupled one to the other by a connector 27. The connector 27 is preferably formed from one or more steel members of a predetermined length. The length of the connector 27 is determined by the amount of desired lateral distance $T_d$ between the first and second stabilizing members 20, 22. In one preferred embodiment, the distance $T_d$ between the first and second stabilizing members 20, 22 is approximately 1.25 inches. However, the distance between the first and second stabilizing members 20, 22, $T_d$, may vary as a result of the size of the control housing 32 and the chair in which the present invention is employed.

As previously discussed, the first rocker 28 is attached to the first end of the second stabilizing member 22. The first rocker 28 is also operably coupled to the seat component 16 and back 18 of the chair 10. The first rocker 28 has a forward end, a rearward end and a rocker contact surface that engages at least a portion of the interior surface of the seat control housing 32. Similarly, the second rocker 30 is attached to the second end of the second stabilizing member 22 and is also operably coupled to the seat component 16 and back 18 of the chair 10. The second rocker 30 also has a forward end, a rearward end and a rocker contact surface that engages at least a portion of the rocking surface 36 of the seat control housing 32. As discussed herein, the rocker contact surface of both the first and second rockers 28, 30 preferably engages damping material 200 disposed (See FIGS. 7-9) on the rocking surface 36 of the control housing 32. The first and second rockers 28, 30 are both operably coupled to the seat component 16 and back 18 of the chair 10 by known means of attachment. For example, and without limitation, the first and second rockers 28, 30 can be coupled to seat component 16 and back 18 of the chair 10 by fasteners, welding, or other known mechanical or chemical mechanisms used for attaching chair components.

Figure 14A:
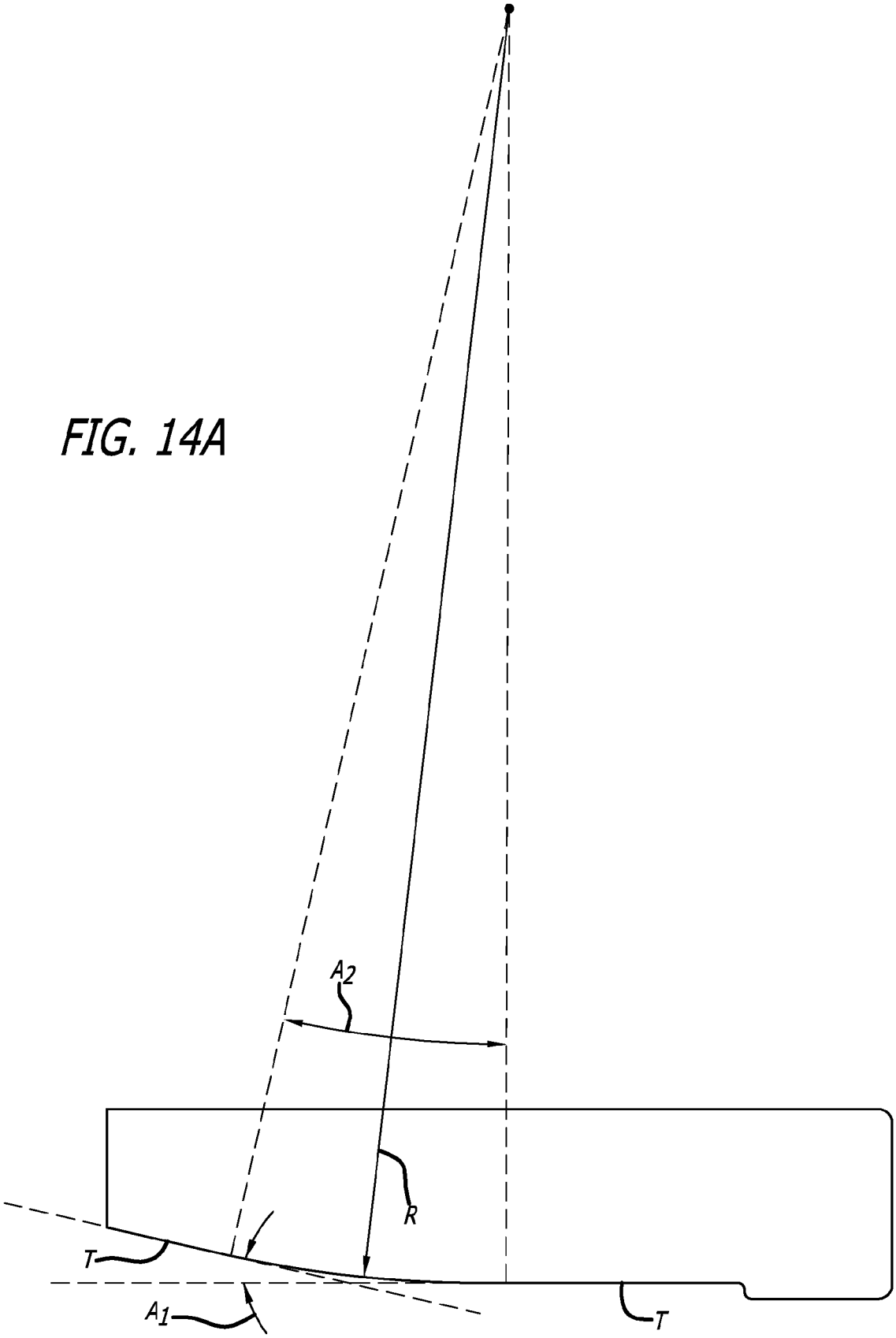
FIG. 14A is a schematic plan view of a rocker used in connection with the with the control system of the present invention.

As shown in FIG. 14A, a portion of the rocker contact surface of each of the first and second rockers 28, 30 generally defines an arc of a circle in an area between two tangents (T). The radius of the defined arc is preferably 5 inches to 20 inches, and more preferably 11 inches to 14 inches. Most preferably, the radius defined by the arc is 12.375 inches. Further, according to one preferred embodiment of the invention, the angle $A_1$ formed between the tangents (T) is preferably an angle of approximately 8° to 20°, and most preferably 12°. However, it will be understood by those of skill in the art the angle formed between the tangents (T) may be any angle suitable for facilitating the transfer, and ultimate dissipation, of loads generated by a seated user through a wide range of motion.

As one of skill in the art would understand, the control system 12 can also include stop limiters. These stop limiters assist in restraining or limiting extreme over-travel of the first and second rockers 28, 30 to provide stability to the chair and for user preference. The stop limiters may be formed of a resilient material such as rubber, or any other material suitable for providing a firm but dampened stop.

The first and second resilient blocks 24, 26 are each comprised of an outer collar 35 and an inner core 38. Preferably, the outer collar 35 is formed from a generally rigid material such as, for example and without limitation, cast aluminum or steel. In one embodiment shown in FIG. 12, the outer collar 35 is a c-shape that is fixedly mounted to the bottom surface 34 of the control housing 32 by conventional fasteners or known welding techniques. However, it will be understood by those of skill in the art that the shape of the outer collar 35 is not limited to the embodiment shown, but can instead assume any geometric configuration or cross-section. Moreover, it will be understood that the method of mounting the outer collar 35 of the resilient block is not limited, but instead can include any known method and means suitable for secure attachment of the resilient blocks 24, 26 to the control housing 32. It is further contemplated that the resilient block can be mounted to other parts of the control housing 32 suitable for secured attachment and creating a control system "ground."

Figure 12:
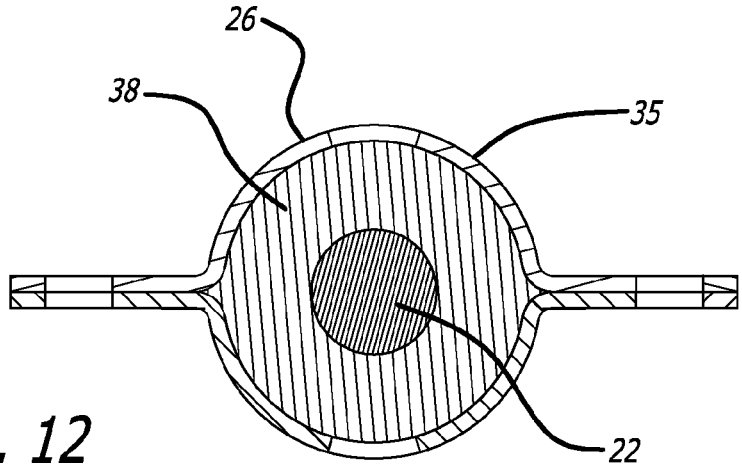
FIG. 12 is a cross-sectional end view of one embodiment of a resilient block used in connection with the control system of the present invention, taken through line 12-12 of FIG. 8.

Referring now to FIG. 12, the inner core 38 of the first and second resilient blocks 24, 26 is formed from a resiliently compressible material. Preferably, the inner core 38 of the first and second resilient blocks 24, 26 is formed from natural rubber. However, it is contemplated that the inner core 38 be formed from a synthetic rubber or any material that is capable of compressible deformation when a force is applied thereto, but also having sufficient resiliency to return to substantially the same state of the material prior to application of such force. It will further be understood that any such material will have deformation thresholds and may lose some degree of resiliency after some predetermined number of cycles. However, such inherent limitations in the properties of a given material should not detract from the present invention.

A chair 10 employing the present invention can further include a mounting assembly for slidably attaching the seat component 16 to the control system 12. According to one embodiment of the present invention, the seat plate of the chair component 16 is attached to the first and second rockers 28, 30 by a screw, bolt, pin, weld or any other method suitable for securable attachment of the seat plate to the rockers 28, 30. This assembly (i.e., the seat plate and rockers) provides a platform for slidably receiving and engaging the seat shell of the seat component 16 thereto. According to one embodiment, to accommodate slidable engagement, the mounting assembly can include a connection tab disposed on either the seat plate or the seat shell of the seat component 16. The mounting assembly also includes a receiving tab configured to slidably engage the connection tab. The receiving tab is disposed on the other of the seat plate and seat shell of the seat component 16. Accordingly, when the seat component 16 is assembled the seat shell can be slid relative to the seat plate mounted control system 12 so that the connection tab slidably engages the receiving tab. The mounting assembly may also include a tongue and groove locking assembly or another mechanism suitable for securable attachment of the seat shell of the seat component 16 to the control system 12 via the seat plate. Alternatively, the mounting assembly may act merely as a locator for assembly. In such an instance one of skill in the art would understand that fasteners may be employed to secure the seat shell to the seat plate seat component 16.

Figure 11:
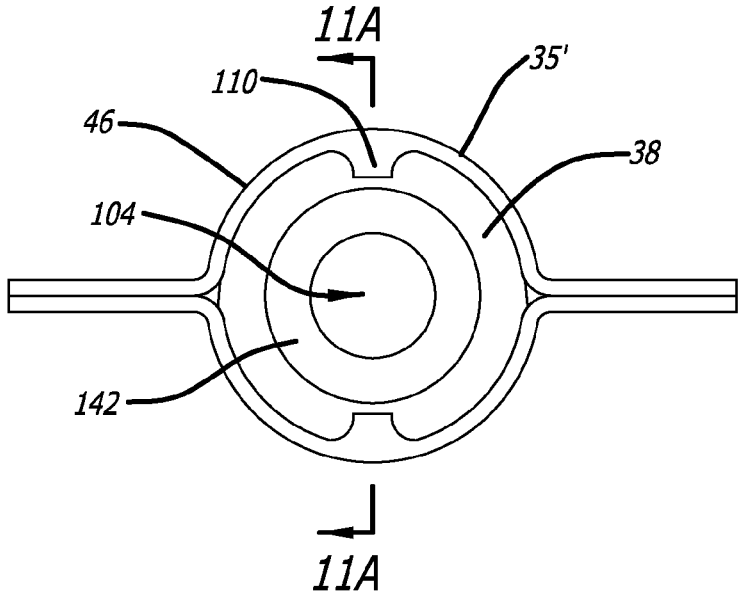
FIG. 11 is a side view of one embodiment of a resilient block used in connection with the control system of the present invention.
Figure 11A:
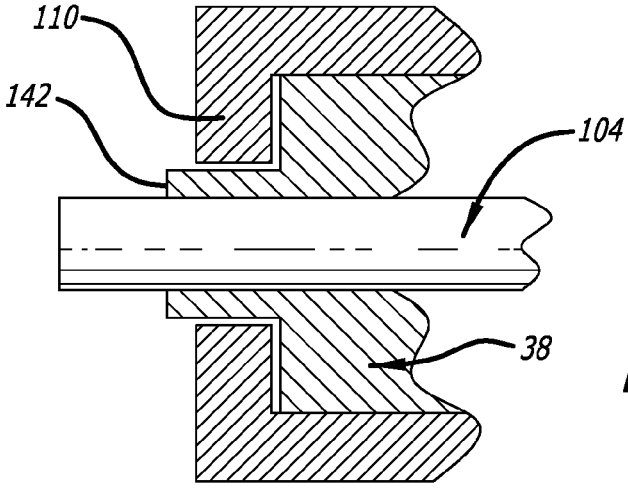
FIG. 11A is a cross-sectional view of the resilient block shown in FIG. 11, taken through line 11A-11A of FIG. 11.
Figure 15:
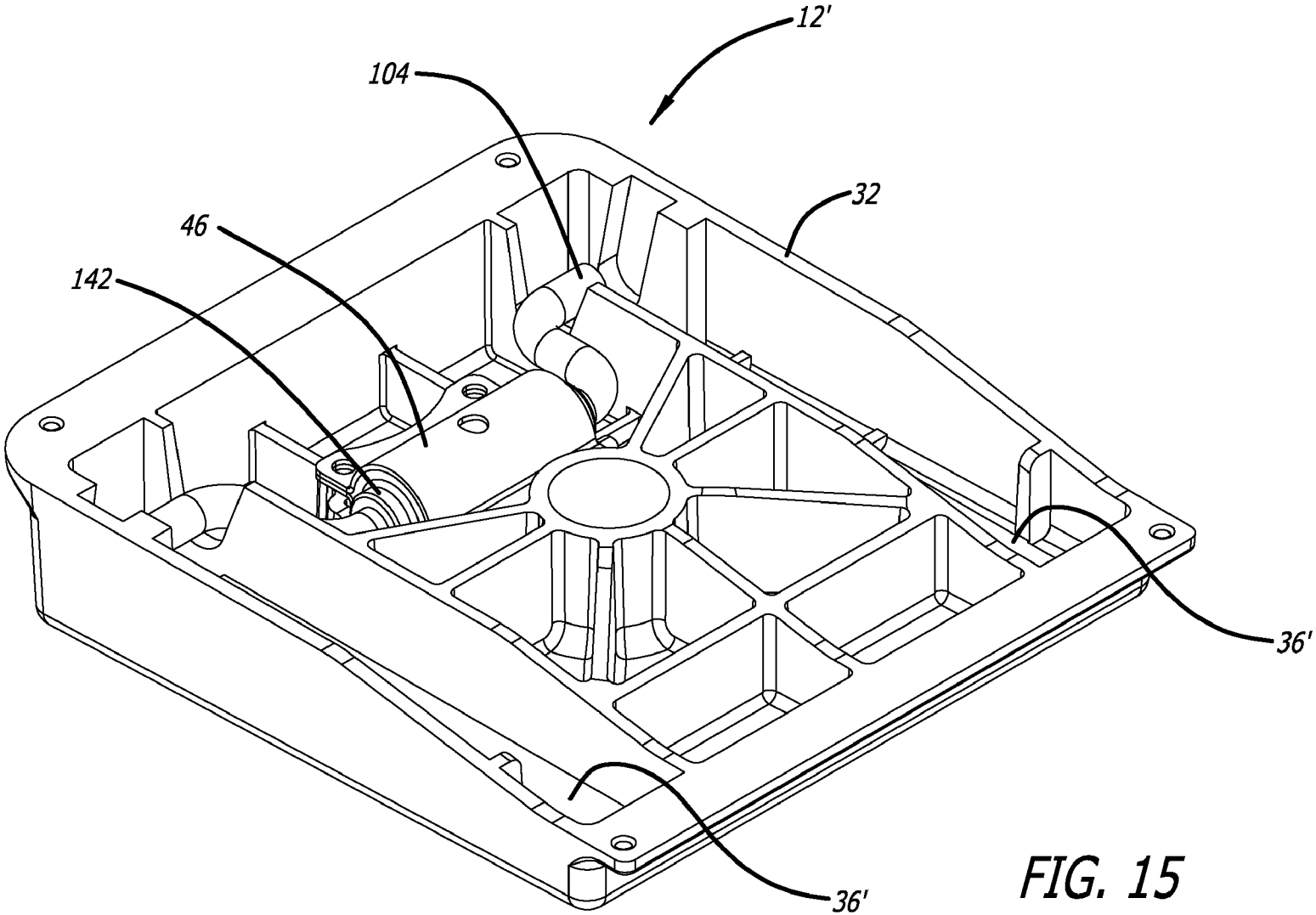
FIG. 15 is a perspective view of a another embodiment of a control system according to the present invention, shown without rockers.

Another embodiment of the seat control system 12' of the present invention is illustrated in FIGS. 15-17. According to the embodiment shown, the control system 12' includes at least one resilient block 46, a single stabilizing member 104 and first and second rockers (not shown). As shown in FIGS. 11 and 11A, the resilient block 46 of this embodiment of the invention is comprised of a outer collar 35' and an inner core 38. Preferably, the outer collar 35' is formed from a generally rigid material such as, for example but without limitation, cast aluminum or steel. The outer collar 35' is c-shape that is fixedly mounted to the bottom surface 34 of the control housing 32 by conventional fasteners or known welding techniques. However, it will be understood by those of skill in the art that the shape of the outer collar 35' is not limited to the embodiment shown, but can instead assume any geometric configuration. It will further be understood that the method of mounting the outer collar 35' of the resilient block 46 is not limited, but instead can include any known method and means suitable for secure attachment of the resilient block 46 to the control housing 32. It is further contemplated that the resilient block 46 can be mounted to other parts of the control housing 32 suitable for secured attachment.

In one embodiment of the present invention, the outer collar 35' of the resilient block 46 includes a stepped collar 142. As shown in FIGS. 11 and 11A, the stepped collar 142 exposes only a portion of the inner core 38 of each of the resilient block 46. Thus, the stepped collar 142 comes in contact with tabs 110 to retard complete compression of the inner core 38 when compressive force is applied to the inner core 38 by the stabilizing member 104 to the inner core 38. Although it is preferable that this particular configuration of the resilient block 46 is employed with the embodiment of the invention shown in FIGS. 15-17, it will be understood that the stepped collar 142 can also be employed with the embodiment of the invention shown in FIGS. 6-9 and described above.

The inner core 38 of the resilient block 46 is formed from a resiliently compressible material. Preferably, the inner core 38 of the resilient block is formed from natural rubber. However, it is contemplated that the inner core 38 be formed from any material that is capable of compressible deformation when a force is applied thereto, but also having sufficient resiliency to return to substantially the same state of the material prior to application of such force. It will further be understood that any such material will have deformation thresholds and may lose some degree of resiliency after some predetermined number of cycles. However, such inherent limitations in the properties of a given material should not detract from the present invention.

As shown in FIG. 16, the stabilizing member 104 has a first end, an opposed second end and a middle portion. The first and second ends of the stabilizing member 104 define a second horizontal axis ($x_2$). The middle portion of the stabilizing member 104 extends through the inner core 38 of the resilient block and defines a first horizontal axis ($x_1$). The second horizontal axis ($x_2$) is disposed parallel to the first horizontal axis ($x_1$). The first end and the second end of the stabilizing member 104 are respectively coupled to the first and second rockers (not shown). The first and second rockers are in turn coupled to the seat component 16 of the chair 10. Thus, the first and second ends of the stabilizing member 104 receive a load applied to the seat component 16 of the chair 10. The middle portion of the stabilizing member 104 facilitates the transfer of the load received by the first and second ends of the stabilizing member 104 to the resilient block 46 to absorb and store residual energy. Thus, loads received by the first and second ends of the stabilizing member 104 are effectively channeled to "ground."

In one preferred embodiment, the distance $T_d$ between the first horizontal axis ($x_1$) and the second horizontal axis ($x_2$) is approximately 1.25 inches. However, it will be understood that the distance $T_d$ between the first and second axes may be vary relative to the size of the control housing 32 and the chair in which the present invention is employed.

According to a preferred embodiment of the present invention, first and second rockers are positioned within the control housing 32 to engage the at least one rocking surface 36'. The rocking surface 36' can also include a damping material disposed on at least a portion of the rocking surface 36'. The damping material may be any material that helps to retard non-harmonious engagement of the rocker members with the rocking surface 36' and thus assists in reducing noise and interference resulting from the engagement of the rocker members thereon. For example, and without limitation, the damping material can be a natural rubber, a synthetic rubber or any other known suitable damping material. Thus it is contemplated that the rocker contact surface of the first and second rockers can engage the dampening material. Alternatively, the rocker contact surface of the first and second rockers can directly engage the bottom surface 34 of the control housing 32 when no dampening material is employed.

While the specific embodiments have been illustrated and described, numerous modifications come to mind without significantly departing from the spirit of the invention, and the scope of protection is only limited by the scope of the accompanying claims.

What is claimed is:

1. A control system for a chair comprising:

a first resilient block;

a second resilient block;

a first stabilizing member defining a first horizontal axis, the first stabilizing member having a first end and a second end, wherein the first end of the first stabilizing member extends into the first resilient block and the second end of the first stabilizing member extends into the second resilient block;

a second stabilizing member coupled to the first stabilizing member by a connector, the second stabilizing member having first and second ends and defining a second horizontal axis disposed in parallel to the first horizontal axis;

a first rocker attached to the first end of the second stabilizing member; and, a second rocker attached to the second end of the second stabilizing member, wherein the second rocker is movable independent of the first rocker; and, a coupling assembly for coupling the first and second ends of the second stabilizing member to the respective first and second rockers, wherein the coupling assembly permits translation of each of the first and second rockers relative to the second stabilizing member in a direction perpendicular to the second horizontal axis.

2. The control system of claim 1 wherein each of the first and second resilient blocks includes an inner core formed from a resiliently compressible material, and wherein the first and second ends of the first stabilizing member extend into the inner core of the respective resilient blocks.

3. The control system of claim 1 further comprising a coupling assembly for coupling the first and second ends of the second stabilizing member to the respective first and second rockers, wherein the coupling assembly permits rotation about the second horizontal axis.

4. The control system of claim 1 wherein the coupling assembly further permits rotation about the second horizontal axis.

5. The control system of claim 4 wherein the coupling assembly comprises:

a slot disposed in each of the first and second rockers; and, slider bearings at each of the first and second ends of the second stabilizing member, wherein the first and second ends of the second stabilizing member rotatably engage a respective slider bearing, and each of the slider bearings slidably engages the slot in the corresponding one of the first and second rockers.

6. The control system of claim 1 further comprising a control housing having an interior bottom surface, wherein the first and second resilient blocks, the first and second stabilizing members and the first and second rockers are disposed within the control housing, the interior bottom surface comprising at least one rocking surface, the first and second rockers being positioned within the control housing to engage the at least one rocking surface.

7. The control system of claim 6 further comprising damping material disposed between the rocking surface and the rocker.

8. The control system of claim 1 wherein a portion of each of the first and second rockers generally defines an arc in an area between two tangents, wherein the radius of the arc is 5 inches to 20 inches.

9. The control system of claim 8 wherein the radius of the arc is 11 inches to 14 inches.

10. The control system of claim 8 wherein the radius of the arc is 12.375 inches.

11. The control system of claim 8 wherein the angle between the tangents is approximately 8° to 20°.

12. The control system of claim 8 wherein the angle between the tangents is approximately 12°.

13. A control system for a chair comprising:

at least one resilient block having an inner core, wherein at least a portion of the inner core of the resilient block is formed from a resiliently compressible material;

a stabilizing member having a first end an opposed second end and a middle Portion, the first and second ends of the stabilizing member defining a first horizontal axis the middle portion of the stabilizing member extending through the inner core of the at least one resilient block and defining a second horizontal axis, the second horizontal axis being disposed parallel to the first horizontal axis;

a first rocker coupled to the first end of the stabilizing member; and, a second rocker coupled to the second end of the stabilizing member, wherein the second rocker is movable independent of the first rocker; and, a coupling assembly for coupling the first and second ends of the stabilizing member to the respective first and second rockers, wherein the coupling assembly permits translation of each of the first and second rockers relative to the stabilizing member in a direction perpendicular to the second horizontal axis during recline.

14. The control system of claim 13 wherein the coupling assembly further permits rotation about the second horizontal axis.

15. The control system of claim 14 wherein the coupling assembly comprises:

a slot disposed in each of the first and second rockers; and, slider bearings at each of the first and second ends of the second stabilizing member, wherein the first and second ends of the second stabilizing member rotatably engage a respective slider bearing, and each of the slider bearings slidably engages the slot in the corresponding one of the first and second rockers.

16. The control system of claim 13 further comprising a coupling assembly for coupling the first and second ends of the second stabilizing member to the respective first and second rockers, wherein the coupling assembly permits rotation about the second horizontal axis.

17. The control system of claim 13 wherein the resilient block comprises:

a pair of stepped collars, the stepped collars exposing a portion of the inner core into which the middle portion of the stabilizing member extends; and, a tab disposed on opposed sides of the resilient block, wherein the stepped collar and tab are provided for limiting compression of the inner core when side-to-side force is applied to the inner core by the stabilizing member to the inner core.

18. A seating unit for supporting a seated user, the seating unit comprising:

a base;

a back component;

a seat component; and, an underseat control system for a chair, the underseat control system being operably coupled to the seat component and being disposed in a seat control housing having an interior bottom surface, the underseat control system comprising:

a first resilient block and a second resilient block, each of the first and second resilient blocks having an inner core, wherein at least a portion of the inner core of each of the first and second resilient blocks is formed from a resiliently compressible material;

a first stabilizing member defining a first horizontal axis, the first stabilizing member having a first end and an opposed second end, wherein the first end of the first stabilizing member extends into the inner core of the first resilient block and the opposed second end of the first stabilizing member extends into the inner core of the second resilient block;

a second stabilizing member coupled to the first stabilizing member by a connector, the second stabilizing member having first and second opposed ends and defining a second horizontal second axis disposed in parallel to the first stabilizing member;

a first rocker operably coupled to a seat component of a chair and being attached to the first end of the second stabilizing member, the first rocker having a forward end and a rearward end and a rocker contact surface that engages at least a portion of the interior surface of the seat control housing; and, a second rocker operably coupled to a seat component of a chair and being attached to the second end of the second stabilizing member, the second rocker having a forward end and a rearward end and a rocker contact surface that engages at least a portion of the interior surface of the seat control housing, and wherein the second rocker is movable independent of the first rocker.

19. The seating unit of claim 18 further comprising a coupling assembly for coupling the first and second ends of the second stabilizing member to the respective first and second rockers, wherein the coupling assembly permits independent motion of each of the first and second rockers relative to the second stabilizing.

20. The seating unit of claim 19 wherein the coupling assembly comprises:

a slot in each of the first and second rockers; and, slider bearings at each of the first and second ends of the second stabilizing member, wherein the first and second ends of the stabilizing member rotatably engage the slider bearing, and the slider bearing slidably engages the slot in the corresponding one of the first and second rockers.

21. The seating unit of claim 18 wherein the interior bottom surface comprising at least one rocking surface, the first and second rockers being positioned within the control housing to engage the at least one rocking surface.

22. The seating unit of claim 21 wherein at least a portion of the at least one rocking surface is comprised of a damping material.

23. The seating unit of claim 18 wherein a portion of each of the first and second rockers generally defines an arc in an area between two tangents, wherein the radius of the arc is 5 inches to 20 inches.

24. The seating unit of claim 23 wherein the radius of the arc is 11 inches to 14 inches.

25. The seating unit of claim 23 wherein the radius of the arc is 12.375 inches.

26. The control system of claim 23 wherein the angle between the tangents is approximately 8° to 20°.

27. The control system of claim 23 wherein the angle between the tangents is approximately 12°.

* * * * *